United States Patent [19]

Zanner et al.

[11] Patent Number: 4,481,863

[45] Date of Patent: Nov. 13, 1984

[54] OPERATING LEVER FOR THE BLOCK AND HAMMER OF A SELF-LOADING HAND FIREARM

[75] Inventors: Georg Zanner, Langenau; Otto Repa, Oberndorf, both of Fed. Rep. of Germany

[73] Assignee: Carl Walther GmbH, Ulm, Fed. Rep. of Germany

[21] Appl. No.: 401,310

[22] Filed: Jul. 23, 1982

[51] Int. Cl.[3] ..... F41C 19/00

[52] U.S. Cl. ..... 89/138; 42/69 B; 89/196

[58] Field of Search ..... 42/69 B, 70 R, 70 A, 42/70 F; 89/138, 148, 163, 196

[56] References Cited

U.S. PATENT DOCUMENTS

| | | | |
|---|---|---|---|
| 1,355,423 | 10/1920 | Pedersen | 89/196 |
| 2,846,925 | 8/1958 | Norman | 89/163 |
| 3,657,959 | 4/1972 | Kart | 89/196 |
| 4,282,795 | 8/1981 | Beretta | 89/148 |

FOREIGN PATENT DOCUMENTS

| | | | |
|---|---|---|---|
| 2443553 | 3/1973 | Fed. Rep. of Germany | 89/138 |
| 2731893 | 2/1978 | Fed. Rep. of Germany | 42/70 F |

*Primary Examiner*—Stephen C. Bentley

*Attorney, Agent, or Firm*—Edmund M. Jaskiewicz

[57] ABSTRACT

A self-loading firearm or pistol has an operating lever which can be actuated by the thumb of the shooting hand in order to release the hammer from its cocked position as well as to release the breech mechanism retaining the block in an open position. The operating lever comprises two operating lever members, each of which is disposed on one side of the firearm and both lever members are rigidly and firmly interconnected such that one of the operating lever members can be actuated by the thumb of the shooter's hand whether it is the right hand or the left hand.

7 Claims, 10 Drawing Figures

Fig. 5
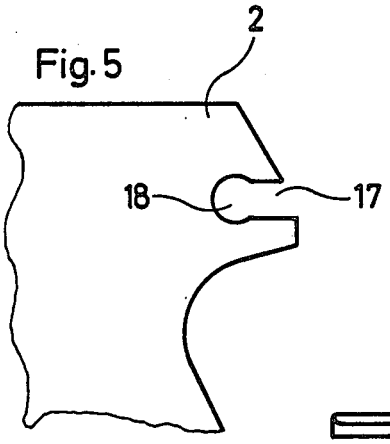
Fig. 4
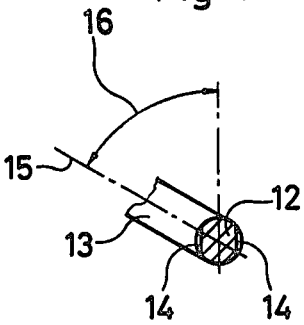
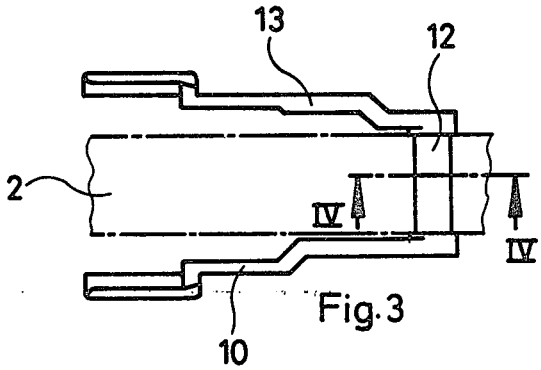
Fig. 3
Fig. 7
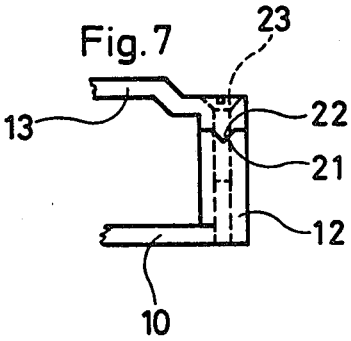
Fig. 6
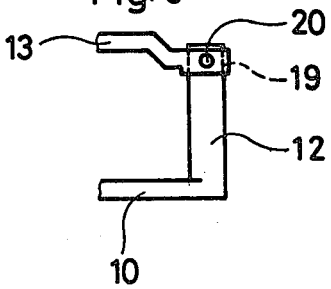

OPERATING LEVER FOR THE BLOCK AND HAMMER OF A SELF-LOADING HAND FIREARM

The present invention relates to a self-loading pistol, more particularly, to such a pistol having an operating lever actuated by the thumb of the shooter's hand to release the cocked hammer as well as to release the slidable block from its open position.

It is known to provide a self-loading pistol or firearm with an operating lever which can be actuated with the thumb of the shooting hand in order to release the hammer from its cocked position as well as to release a slidable block from its open position. Such an operating lever has been positioned on the left side of the pistol and is pivotable about an axis positioned transverse to the direction of firing. The operating lever is thus actuated by being pressed downwardly with the thumb of the shooter's hand which for this construction is the right hand. When the operating lever is pressed down, the hammer is released from its cocked position and brought into the uncocked position. The operating lever is also connected with the breech mechanism retaining structure which retains the slidable block in an open position after firing of the last cartridge in the magazine. By pressing down the operating lever when the block or the breech mechanism is in its open position, the breech mechanism retaining structure is released so that the block can move forward again into its closed position.

This known structure of the operating lever has a disadvantage in that the operating lever on the left side of the pistol can only be actuated by right-handed people. In order to modify the operating lever's structure so that the operating lever can be actuated by a left-handed person, it is generally necessary to rebuild the entire pistol and to mount the operating lever on the right side of the firearm. This necessity for rebuilding adds considerably to the overall cost and expense of such a firearm since, in effect, this procedure requires the building of two different structures.

It is therefore the principal object of the present invention to provide such a self-loading pistol having an improved operating lever which can be actuated by either a left-handed or a right-handed person without modification of the weapon structure in order to release the cocked hammer and to release the block from its open position.

According to one aspect of the present invention, a self-loading pistol or hand firearm has an operating lever on each side of the pistol and both operating levers are firmly connected with each other. Thus, an operating lever can be actuated by the thumb of the left hand or the right hand which may hold the hand firearm. This actuation of the operating lever will release the hammer from its cocked position and releases the slidable block from its open position. As a result of the present invention, only one pistol construction is required for left-handed persons as well as for right-handed persons. The same parts and components can always be used as a result of which the manufacture, storage and inventory of spare parts is considerably simplified and reduced in cost.

Other objects and advantages of the present invention which will be apparent upon reference to the accompanying description when taken in conjunction with the following drawings, which are exemplary, wherein;

FIG. 3 is a top plan view of the operating lever according to the present invention;

FIG. 4 is a sectional view taken along the line IV—IV of FIG. 3;

FIG. 5 is an elevational view of the rearward portion of the pistol stock;

FIG. 6 is a top plan view similar to a portion of FIG. 3 and showing a modified attachment of an operating lever to the shaft;

FIG. 7 is a view similar to that of FIG. 6 and showing a second modification thereof;

Proceeding next to the drawings wherein like reference symbols indicate the same parts throughout the various views, a specific embodiment and modifications of the present invention will be described in detail.

Figure 1:
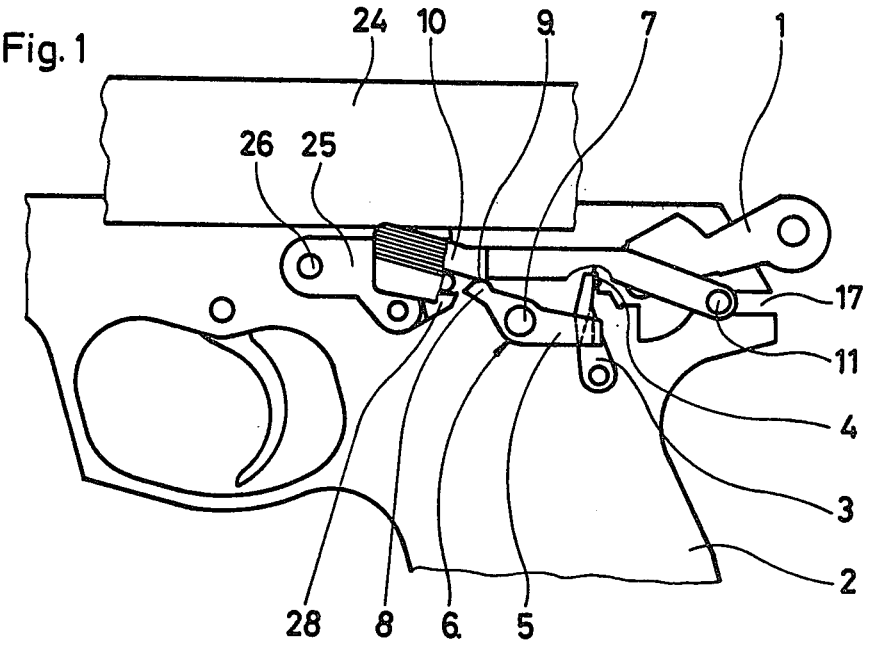
FIG. 1 is a side elevational view of a portion of a hand firearm incorporating the present invention showing the hammer in its cocked position.

As may be seen in FIG. 1, the self-loading pistol or hand firearm incorporating the present invention has a hammer 1 which is pivotably mounted about an axis extending transverse to the direction of the firing. The hammer 1 is shown in the cocked position. A pivotably mounted catch lever 3 has a free end which is engageable in a notch 4 of the hammer so as to retain the hammer in its cocked position. An arm 5 of a two-arm lever 6 which is pivotably mounted about an axis 7 positioned transverse to the direction of firing has a tab or bent portion which is engageable with the catch lever 3. The lever 6 has a second arm 8 the end of which is formed as a cam or rounded portion and is engageable with an abutment face 9 located on the bottom edge of operating lever 10.

Figure 2:
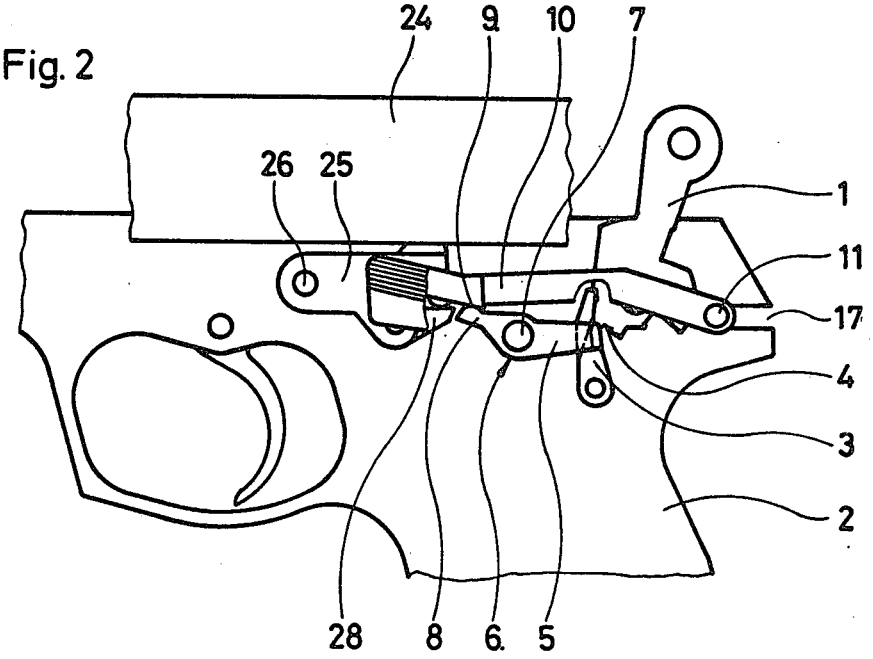
FIG. 2 is a view similar to that of FIG. 1 but showing the hammer in its uncocked position.

The operating lever 10 is pivotably mounted about an axis 11 which is also transverse to the direction of firing and is located in pistol stock 2. The free end of the operating lever 10 is provided with a knurled or corregated portion which is actuated by the thumb of the firing hand. When this lever 10 is pressed downwardly, the catch lever 3 is moved by the two-arm lever 6 to disengage the catch lever 3 from notch 4 so that the hammer can move forwardly under the force of a firing pin spring (not shown but known in the art) into the uncocked or released position shown in FIG. 2.

The structual details of the operating lever, according to the present invention, are shown in FIGS. 3, 4, and 5. The operating lever 10 is constructed as a single integral unit or entity having a shaft 12 and a second operating lever 13 disposed on the other side of the pistol stock 2 as may be seen in FIG. 3. The shaft 12 extends transverse to the firing direction of the firearm and is pivotably mounted in the pistol stock 2. The shaft 12 is provided with two opposed flat parallel surfaces 14 on its circumference which reduces the cross sectional area of the shaft 12 in a direction parallel to the surfaces 14.

The planes of the flat surfaces 14 are pivoted or displaced by an angle 16 of about 60° with respect to the longitudinal axis 15 of the operating levers 10 and 13 as shown in FIG. 4.

The operating lever 10, 12, 13 is assembled on the firearm by positioning the shaft 12 into a bore 18 which extends through the rear portion of the pistol stock 2 as shown in FIG. 5. The bore 18 communicates through a slot 17 to the rear-most edge of the pistol stock as also shown in FIG. 5. The width of the slot 17 corresponds closely to the distance between the flat surfaces 14 of the shaft 12 so that the flattened portion of the shaft 12 can be slid through the slot 17 to position the shaft 12 into the bore 18.

After the shaft 12 has been positioned into the bore 18, the operating lever 10, 12, 13 is pivoted through the angle 16 into its functioning or operative position as may be seen in FIG. 1. In this functioning position, the flattened surfaces 14 of the shaft 12 are in a position transverse to the longitudinal direction of the slot 17 so as to prevent the displacement of the operating lever 10, 12, 13 from the pistol stock.

The pivoting movement of the operating lever 10, 12, 13 is limited in a downward direction by its contact and support on arm 8 of the intermediate lever 6 (FIG. 1). The pivoting of the operating lever in an upward direction is limited by a stop pin which may be mounted on the operating lever 10 after the operating lever 10, 12, 13 has been mounted in the pistol stock as described above.

The operating lever 10, 12, 13 is preferably constructed as a single unit and preferably manufactured as a high quality cast part. The construction of the operating lever component as a single unit also avoids any loosening or play in the connection between the operating levers because of vibrations or shocks occurring upon firing of the firearm.

The shaft 12 of the operating lever assembly is constructed so that when positioned in the bore 18 both ends of the shaft 12 project outwardly of the respective sides of the pistol stock. The operating levers 10 and 13 are then mounted upon these projecting free ends of the shaft 12.

In FIG. 6, there is illustrated a modification of the operating lever unit wherein only one operating lever 10 and the shaft 12 are constructed as a one-piece integral unit. The other or free-end of the shaft 12 which projects outwardly on the other side of the pistol stock 2 is inserted into a bore or opening 19 formed in an end of the operating lever 13. A pin 20 is then passed transversely through the portion of the operating lever surrounding the bore 19 and the shaft 12 in order to provide a non-rotatable fixed connection between the shaft 12 and the operating lever 13. This non-rotatable connection between the shaft 12 and the operating lever 13 can be readily disconnected by removal of the pin 20 in order to facilitate the removal of the entire operating lever unit from the pistol stock or to provide for assembly or mounting of this operating lever unit.

In FIG. 7 there is shown a further modification of the operating lever structure wherein operating lever 10 is similarly constructed integrally or in one piece with the shaft 12. However, the shaft 12 is hollow so as to define a tubular construction and at the free end of the hollow shaft 12 there is formed a transversely extending notch 21. The operating lever 13 is provided with a rib or projection 22 on its inner surface so as to be closely received within the notch 21. A screw 23 is then passed through a suitable opening in the operating lever 13 and is threaded into the interior of the hollow shaft 12 so as to be co-axial therewith. Torque is thus transmitted by the rib 22 from the operating lever 10 to the operating lever 13. This modification also provides for removal of the operating lever 13 from the shaft 12 to facilitate the assembly or disassembly of the operating lever unit from the pistol. Since the notch 21 and the rib 22 are so shaped so as to closely fit with each other it can be seen that a rigid nonrotatable connection is achieved between operating lever 13 and the shaft 12.

Figure 8:
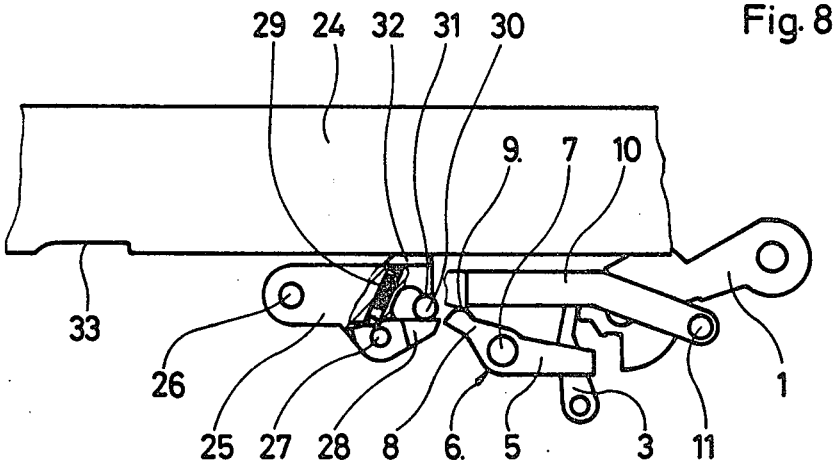
FIG. 8 is a side elevational view of a portion of the firearm incorporating the present invention and showing the slidable block in its closed position.

FIG. 8 illustrates breech block 24 of the pistol in the closed position. A breech block retaining lever 25 is pivotably mounted about axis 26 in the pistol stock 2 and lying transverse to the direction of firing. The retaining lever 25 is shown in FIG. 8 in its rest position. A catch member 28 which is pivotable within small limits is pivotably mounted on axis 27 of the breech block retaining lever 25. A spring 29 positioned between the breech block retaining lever 25 and the catch member 28 presses the catch 28 against the underside of a bolt 30 which is fixedly mounted in the pistol stock 2. At the same time, the spring 29 exerts a force against the breech block retaining member 25 by means of a stock member 31 against the upper side of the bolt 30.

Figure 9:
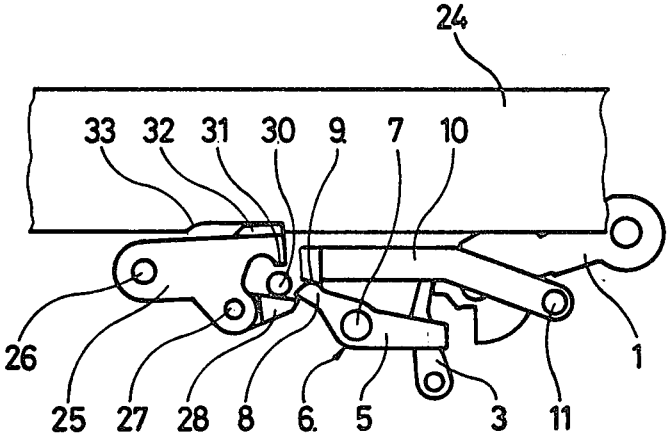
FIG. 9 is a view similar to that of FIG. 8 but showing the block in the open position; and, FIG. 10 is a view similar to that of FIG. 8 and showing the position of the components after release of the block retaining mechanism.
Figure 10:
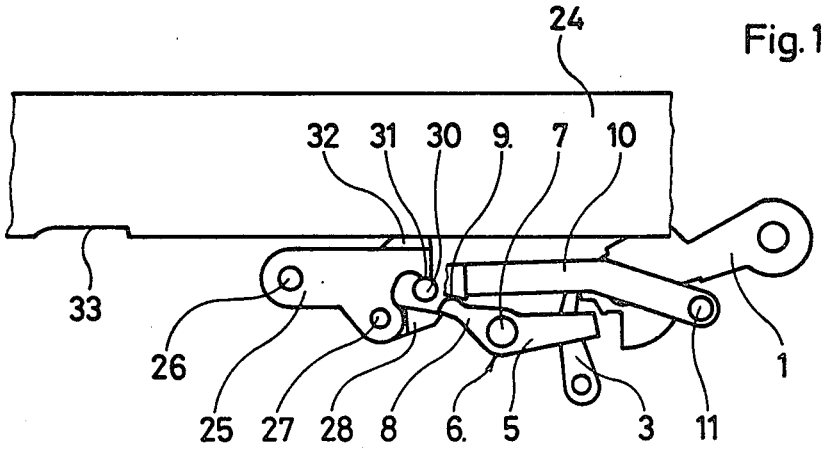

After the last cartridge in the magazine has been fired, the breech block 24 is retained in a known manner in the rear open position by a notch 33 on the underside of block 24 engaging the projection 32 on the breech block retaining member 25 as seen in FIG. 9. When the breech retaining member 25 is moved upwardly, the free end of catch member 28 is now located under the end of arm 8 of the two-armed intermediate lever 6. If the operating lever 10 is now pressed downwardly, arm 8 of the intermediate lever 6 engages the catch member 28 and presses the breech retaining member 25 out of the stop notch 33 of breech block 24. As a result of this action, the breech block 24 is now free to move forward again into its closed position under the force of the breech closing spring not shown. The position of the breach block 24 as a result of this forward movement is shown in FIG. 10.

Upon release of the operating lever 10 from its previous downward position, the components then return to their original positions as shown in FIG. 8.

Thus it can be seen that the present invention has disclosed an improved operating lever for a self loading pistol or hand firearm. The improved operating lever can be actuated from either side of the pistol and can be actuated by the thumb of either a left-handed or right-handed shooter.

It will be understood that this invention is susceptible to modification in order to adapt it to different usages and conditions, and accordingly, it is desired to comprehend such modifications within this invention as may fall within the scope of the appended claims.

We claim:

1. In a self-loading hand firearm, a hammer pivotable between cocked and uncocked positions, a catch lever which retains said hammer in the cocked position, a slidable block having an open position, retaining lever means cooperating with said block for retaining said block in the open position, operating lever means for releasing said hammer from a cocked position and for releasing said retaining lever means to release said block from its open position, said operating lever means comprising a pair of operating levers each of which is disposed on an opposite side of said firearm such that one of said operating levers is actuated by the thumb of the shooter's hand holding the firearm, means firmly interconnecting said operating levers and a pivotably mounted two-armed lever having first and second arms, one of said operating levers has on its underside an abutment face cooperating with said first arm, said first arm operatively cooperating with said retaining lever means, said second arm operatively cooperating with a catch lever.

2. In a self-loading hand firearm, as claimed in claim 1, wherein said firearm has a pistol stock, a shaft pivotably mounted in said pistol stock and having its ends thereof projecting outwardly on either side of said firearm, each one of said operating levers being attached to a said end of said shaft.

3. In a self-loading hand firearm as claimed in claim 2, wherein said pair of operating levers and said shaft define a single unit, said shaft having a pair of opposed flat parallel surfaces thereon, there being a bore through said pistol stock and a slot extending from said bore to open on a rear side of said pistol stock, said shaft flat surfaces being so spaced that said flattened shaft portion passes through said slot whereby said shaft is pivotably positioned in said bore.

4. In a self-loading hand firearm, as claimed in claim 3, wherein the planes of said shaft parallel surfaces define an angle with the longitudinal axis of said operating levers such that after the shaft is positioned in said bore and said operating levers placed in their operating positions the shaft is prevented from being displaced from said bore.

5. In a self-loading hand firearm as claimed in claimed 2, wherein one of said operating levers is detachably attached to an end of said shaft.

6. In a self-loading hand firearm as claimed in claim 5, wherein said one operating lever has a bore there through receiving a free end of said shaft, and a pin passing through said operating lever and said shaft end to connect said operating lever nonrotatably to said shaft.

7. In a self-loading hand firearm, as claimed in claim 5, wherein said shaft is tubular and has a transverse notch on a free end thereof, said one operating lever has a rib closely fitting into said notch and a bore there through, and a screw passing through said operating lever bore and threaded into said tubular shaft to retain said one operating lever nonrotatably on said shaft.

* * * * *